US009119980B2

(12) United States Patent
Stenseide

(10) Patent No.: US 9,119,980 B2
(45) Date of Patent: Sep. 1, 2015

(54) FIRE PROTECTED STEEL STRUCTURE AND REMOVABLE PANELS FOR FIRE PROTECTION OF STEEL STRUCTURES

(71) Applicant: Beerenberg Corp. AS, Bergen (NO)

(72) Inventor: Magne Stenseide, Kjerrgarden (NO)

( * ) Notice: Subject to any disclaimer, the term of this patent is extended or adjusted under 35 U.S.C. 154(b) by 0 days.

(21) Appl. No.: 13/966,725

(22) Filed: Aug. 14, 2013

(65) Prior Publication Data

US 2013/0326975 A1 Dec. 12, 2013

Related U.S. Application Data

(63) Continuation of application No. 13/885,615, filed as application No. PCT/NO2011/000276 on Sep. 28, 2011, now abandoned.

(30) Foreign Application Priority Data

Dec. 14, 2010 (NO) ..... 20101752

(51) Int. Cl.
*E04C 3/30* (2006.01)
*A62C 2/06* (2006.01)
(Continued)

(52) U.S. Cl.
CPC ... *A62C 2/06* (2013.01); *E04B 1/24* (2013.01); *E04B 1/944* (2013.01); *E04B 9/005* (2013.01); *E04B 1/94* (2013.01); *Y10S 428/92* (2013.01); *Y10T 29/49986* (2015.01)

(58) Field of Classification Search
CPC ..... E04B 1/944; E04B 1/24; E04B 9/005; E04B 1/94; Y10S 428/92; Y10S 428/921; Y10S 52/08; Y10T 52/08; A62C 2/06
USPC ..... 52/405, 576, 309.17, 596
See application file for complete search history.

(56) References Cited

U.S. PATENT DOCUMENTS 3,217,456 A * 11/1965 Quigg et al. ..... 52/423
3,570,208 A * 3/1971 Nikai et al. ..... 52/746.1
(Continued)

FOREIGN PATENT DOCUMENTS

EP 0 511 017 10/1992
GB 1084503 9/1967
(Continued)

OTHER PUBLICATIONS

International Search Report issued Mar. 9, 2012 in corresponding International Application No. PCT/NO2011/000276.
(Continued)

*Primary Examiner* — Basil Katcheves
*Assistant Examiner* — Joshua Ihezie
(74) *Attorney, Agent, or Firm* — Wenderoth, Lind & Ponack, L.L.P.

(57) ABSTRACT

A fire protected steel structure with at least one fire protection panel covering the steel structure. The panel includes a perforated metal plate (14) and an inner expanding fire protecting layer (12) with a thickness (t1) on an inside of the perforated metal plate (14) and an outer expanding fire protecting layer (13) with a thickness (t2) on an outside of the perforated metal plate (14). The fire protecting layers extend through the perforated metal plate (14). Releasable mechanical fasteners for removable attachment of the at least one fire protection panel to the steel structure is provided. Furthermore, the invention concerns a panel for fire protection of a steel structure.

11 Claims, 10 Drawing Sheets

(51) Int. Cl.

| | |
|---|---|
| ***E04B 9/00*** | (2006.01) |
| ***E04B 1/24*** | (2006.01) |
| *E04B 1/94* | (2006.01) |

(56) References Cited

U.S. PATENT DOCUMENTS

| | | | | |
|---|---|---|---|---|
| 3,604,167 | A * | 9/1971 | Hays | 52/282.4 |
| 3,908,327 | A * | 9/1975 | Quigg | 52/834 |
| 3,998,028 | A * | 12/1976 | Pelletier et al. | 52/834 |
| 4,567,705 | A * | 2/1986 | Carlson | 52/405.3 |
| 4,683,019 | A * | 7/1987 | Motoki | 156/293 |
| 4,854,107 | A * | 8/1989 | Roberts | 52/834 |
| 5,119,612 | A * | 6/1992 | Taylor et al. | 52/410 |
| 5,187,913 | A * | 2/1993 | Leveau | 52/584.1 |
| 5,402,615 | A * | 4/1995 | Knott et al. | 52/309.1 |
| 5,404,687 | A * | 4/1995 | Blake et al. | 52/600 |
| 5,509,241 | A * | 4/1996 | Coconis et al. | 52/232 |
| 6,141,925 | A * | 11/2000 | Halvorson et al. | 52/238.1 |
| H2063 | H * | 5/2003 | Halsey et al. | 52/232 |
| 7,658,042 | B2 * | 2/2010 | Hiel | 52/289 |
| 7,776,170 | B2 * | 8/2010 | Yu et al. | 156/39 |
| 2005/0031843 | A1 * | 2/2005 | Robinson et al. | 428/293.4 |
| 2005/0272329 | A1 * | 12/2005 | Tueshaus et al. | 442/18 |
| 2006/0070321 | A1 * | 4/2006 | Au | 52/232 |
| 2007/0066165 | A1 * | 3/2007 | Fyfe | 442/59 |
| 2007/0151183 | A1 * | 7/2007 | Stahl et al. | 52/317 |
| 2008/0014398 | A1 * | 1/2008 | Tueshaus et al. | 428/38 |
| 2009/0075051 | A1 * | 3/2009 | Fyfe | 428/297.4 |
| 2009/0255619 | A1 | 10/2009 | Tong | |
| 2010/0294519 | A1 * | 11/2010 | Beele | 169/45 |
| 2011/0056163 | A1 * | 3/2011 | Kure | 52/741.3 |
| 2011/0088342 | A1 * | 4/2011 | Stahl et al. | 52/220.8 |
| 2012/0148812 | A1 * | 6/2012 | Kipp et al. | 428/213 |
| 2012/0304979 | A1 * | 12/2012 | Munzenberger et al. | 126/314 |
| 2013/0263551 | A1 * | 10/2013 | Liberman | 52/742.16 |

FOREIGN PATENT DOCUMENTS

| | | | |
|---|---|---|---|
| GB | 2071078 | * | 9/1980 |
| GB | 2 429 983 | | 3/2007 |
| JP | 2006-274585 | | 10/2006 |

OTHER PUBLICATIONS

International Preliminary Report on Patentability issued Mar. 14, 2013 in corresponding International Application No. PCT/NO2011/000276.

Norwegian Search Report issued Jul. 14, 2011 in corresponding Norwegian Application No. 20101752.

* cited by examiner

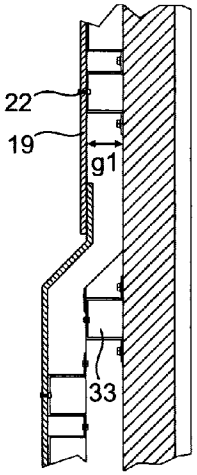
FIG. 6
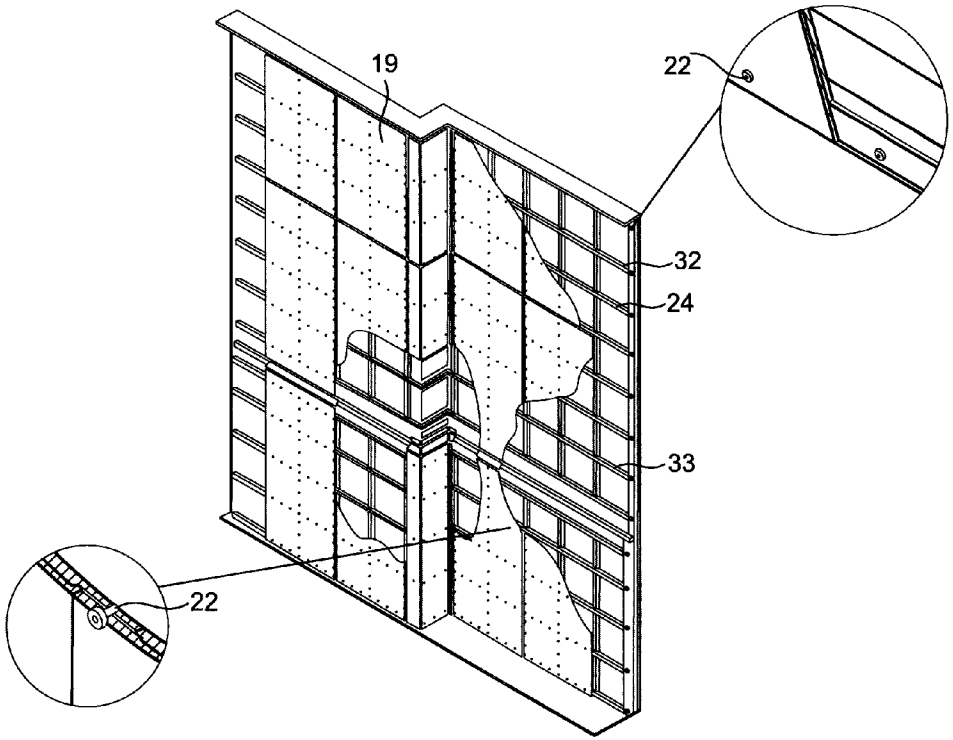
FIG. 9
FIG. 8
FIG. 7

FIRE PROTECTED STEEL STRUCTURE AND REMOVABLE PANELS FOR FIRE PROTECTION OF STEEL STRUCTURES

BACKGROUND OF THE INVENTION

1. Field of the Invention

The present invention concerns a fire protected steel structure and removable panels for fire protection of steel structures. The panels are intended for covering steel structures such as tubular elements, girders, tanks, flanges, valves, columns, panels, walls etc. in particular for offshore installations, process plants, vessels, or anywhere metal structures are used in an environment where fire protection is an issue.

2. Description of the Related Art

In fires in or close to steel structures, it is of considerable importance that the structures are sufficiently fire protected to maintain the functionality and ability to carry load. The steel structures may be of any shape, for instance cylindrical, square, shaped as girders, columns or walls.

Fires that occur in for instance hydrocarbon producing or processing installations may threaten the structural integrity of the carrying steel structures (girders/columns) of the installation. Failure of a load carrying steel structure of an installation may lead to considerable damage both to personnel and equipment and may result in considerable pollution.

Accordingly, it has been proposed to provide such installations with some sort of passive heat insulation, seeking to reduce the thermal loads on the structure in the event of a fire. When such fire insulation is tested, resistance against jets and hydrocarbon fires, fire and explosion loads should also be documented.

There are various requirements and standards for passive fire and explosion protection of steel structures throughout the world. In most cases a load carrying steel structure should be able to resist both jet and hydrocarbon fires from 60 to 120 minutes without the radiated temperature exceeding 400° C. The steel structures should in most cases also be able to withstand an explosion pressure of up to 0.3 bar. A flame temperature during jet or hydrocarbon fires may exceed way beyond 1300° C.

Examples of such standards include Norsok Standard S-001 N and R-004, UL Standard Fire resistance Rating ANSI UL 263 and ANSI/UL 1709. The solution of the present invention fulfils these standards.

Current passive fire protecting solutions for load carrying steel structures usually include expandable/intumescent, fire insolating epoxy substances or cement based light weight concrete. These substances are sprayed directly onto the structure to be protected.

This solution has some obvious disadvantages. Chisel and chisel hammer must normally be used to remove the fire protecting substance from the structure. Tools (for instance angle grinder) that heat the fire insolating substance should not be used as toxic hydrocyanic acid gasses may develop. Inspection of welding zones, corrosion damage, corrosion protecting coatings or any repair work or modifications is difficult when the protected structure is coated directly onto the surface.

Fire insolating epoxy substances are very difficult to apply in places with high humidity. Cement based light concrete is primarily used in these conditions. Light concrete that can be sprayed is however not impervious and absorbs humidity that contributes to corrosion. Furthermore, concrete has a tendency to deteriorate in time whereby the fire protecting properties are reduced.

A problem when using epoxy based substances is that high temperatures are required during application, and that the equipment used is not suitable for use in oil and gas installations due to the fire and explosion hazards. Substantially all the passive fire protection on oil and gas installations is applied manually. There are also considerable problems with fire insolating epoxy substances in terms of HSE. Hazardous gasses are released during application and in the period when the epoxy sets. This typically leads to epoxy allergy with the personnel, thus preventing any further work with epoxy.

It is a purpose of the present invention to provide a solution that fulfils the required standards, that not promotes corrosion, that not absorbs humidity, that has a reasonable weight, that allows integrity of the structure to be protected, that is easy to produce, that can be adapted to be used on a multitude of structures and that can be used under all relevant climatic conditions. Furthermore, it is an object to provide a solution with a life span of 25 years without substantial maintenance. It is also a purpose of the present invention to provide a system that can be installed without having to shut down the structure to be protected (eg. an offshore platform) for application. Furthermore it is a purpose to provide a system that can be installed in spite of an environment with explosion hazard. The solution should also satisfy all relevant requirements for HSE within the relevant sectors such as within the oil and gas industry.

An important feature with the invention is that instead of applying the passive fire protection directly onto the structure to be protected, prefabricated fire protecting panels are installed onto the structure to be protected while maintaining suitable conditions relating to ventilation, temperature and humidity. The solution of the present invention includes panels that are easy to remove to ease inspection of for instance welding zones, to check for corrosion, cracks, deformation and corrosion protecting coatings. The removable panels may also be adapted for a multitude of uses and as they are easy to remove, attachment of various equipment, repair operations and modifications is facilitated. The panels can be installed in environments exposed to fire and explosion hazards without requiring explosion protected equipment.

The epoxy layer used in the panels according to the invention will typically begin to expand when exposed to temperatures of more than 200° C. The layer typically expands to five times the initial thickness when it is exposed to jet and hydrocarbon fires. It is this expanded epoxy layer that provides the thermal insulation during fire. It should always be a distance between the protecting panels and the structure to be protected for allowing this expansion. The necessary distance will clearly depend on the thickness of the expanding layer. The fire protecting requirements, the thickness of the material to be protected and the time the material to be protected must maintain its integrity are decisive factors for determining the thickness of the epoxy layer.

The panels have very low thermal insulating properties before they are exposed to heat, and this is favorable as ideally the panels have the same temperature on the inside and the outside to prevent condensation on the structure to prevent corrosion.

The panel joints should generally be open, but will be sealed when the panels begin to expand at higher temperatures.

The panels may for instance be designed to withstand jet fires (gas fire) of 350 k/Wm$^2$ of heat flux, suggesting temperatures considerably exceeding 1300° C. The panels have been tested for hydrocarbon fires with radiation heat of 1100° C.

SUMMARY OF THE INVENTION

Accordingly, the present invention concerns a fire protected steel structure comprising at least one fire protection panel covering the steel structure. For instance in the case of embedded beams and girders, only one cover may be necessary. However, the protection typically includes several panels for covering a structure as will be shown in the drawings. All the panels include a perforated metal plate and an inner expanding fire protecting layer with a thickness on an inside of the perforated metal plate and an outer expanding fire protecting layer with a thickness on an outside of the perforated metal plate. The embedded, perforated plate is in other words covered with unexpanded epoxy on both sides. The fire protecting layer extends through the perforated metal plate. Releasable mechanical fasteners are provided for removable attachment of the at least one fire protection panel to the steel structure. The releasable attachment may be a direct attachment to the structure, or may be provided by panels surrounding the structure. Preferably, the panels are secured directly to the structure with screws, bolts etc., and panel joints are clamped to each other with suitable joining elements such as clamps.

The releasable mechanical fasteners may include an attachment nut and a threaded attachment bar secured to the steel structure.

The releasable mechanical fasteners may be covered with a heat insulating fastener cover on an outside of the panel, opposite the steel structure. The fastener cover may be of a hat shaped channel that can be screwed or pop-riveted to the panel to be secured to the underlying structure.

The releasable mechanical fasteners may include over-a-center position clamping elements or a combination of attachment nuts and threaded attachment bars.

A gap with a gap clearance may be provided between the steel structure and the fire protection covers, and the gap may be greater than five times the thickness of the inner expanding fire protecting layer. The ideal gap clearance however depends on the rate of expansion of the expanding layer, and the gap clearance should allow full expansion of the inner layer. It is however difficult to provide a full clearance everywhere due to attachment issues, but the panels will still provide effective protection even if the panels are close to the underlying structure in some areas. The heat will also propagate to colder areas thus reducing the heat load.

The fire protected steel structure may further include an attachment element with tensioning units for providing a holding force between the attachment element and the steel unit. The releasable mechanical fasteners may then be attached to the attachment element.

The at least one fire protection panel may further include drainage holes for preventing accumulation of liquid inside the at least one fire protection panel. The drainage holes become sealed when the expanding fire protecting layer expand in a fire.

The drainage holes may be formed in an open attachment bushing extending through the panel. The bushing may include an inner layer of expanding fire protecting material, sealing said open attachment bushing in the event of a fire.

Ventilating channels for preventing accumulation of humidity may be formed between the steel structure and the at least one panel.

The invention furthermore concerns a panel for fire protection of a steel structure comprising a perforated metal plate and an inner expanding fire protecting layer with a thickness on an inside of the perforated metal plate and an outer expanding fire protecting layer with a thickness on an outside of the perforated metal plate. The fire protecting layers extending through the perforated metal plate forms a connection between the inner and outer layers.

The total thickness of the panel including the perforated metal plate, the inner expanding fire protecting layer with a thickness t1 on the inside of the perforated metal plate and the outer expanding fire protecting layer with a thickness t2 on the outside of the perforated metal plate is in a range from 6 mm to 22 mm. This range has been tested in terms of fire protection and ability to withstand explosions with great success. Lower thicknesses reduce the fire preventing properties, and higher thicknesses result in increases in weight and add to the overall cost of the system. It is important that the panels are not too bulky for proper handling.

A reinforcement element may provide a support between the panel and the steel structure in the event of an explosion.

Furthermore, the invention concerns a method of manufacturing a panel for fire protection. The method includes the steps of cutting a perforated metal plate into a shape corresponding to a shape of a steel structure to be protected, bending the perforated metal plate into a shape corresponding to a shape of the steel structure to be protected, coating intumescent epoxy onto a first side of the perforated metal plate, and coating intumescent epoxy onto a second side of the perforated metal plate.

The perforated metal plate may be bent into a shape corresponding to a shape of the steel structure to be protected before coating the perforated plate on both sides with epoxy.

The step of coating the perforated metal plate with intumescent epoxy material may include a spray coating process.

The intumescent epoxy material may be coated with a primer and a water impermeable coat.

A method of the invention for producing a bespoke fire protecting panel includes measuring the steel structure to be protected or cutting out a suitable template, cut a perforated plate into the measured dimensions or according to the template, bend the perforated plate into a suitable shape to cover the structure to be protected, coat both sides of the perforated plate with intumescent epoxy material, and coat the intumescent epoxy material with a water impermeable top coat. The finished, bespoke fire protecting panel may then be attached to the steel structure to be protected using releasable mechanical fasteners as previously described. A clearance between the steel structure to be protected and the fire protecting panel should be maintained, for instance by using suitable spacers.

BRIEF DESCRIPTION OF THE DRAWINGS

FIG. 6 is a cross section of a flat portion, covered with fire protection panels;

FIG. 7 is a perspective view of a detail of FIG. 8, showing a joint;

FIG. 8 is a perspective view of a flat portion, covered with fire protection panels according to the invention;

FIG. 9 is a perspective view of a joint between different fire protection panels;

DETAILED DESCRIPTION OF THE INVENTION

Figure 1:
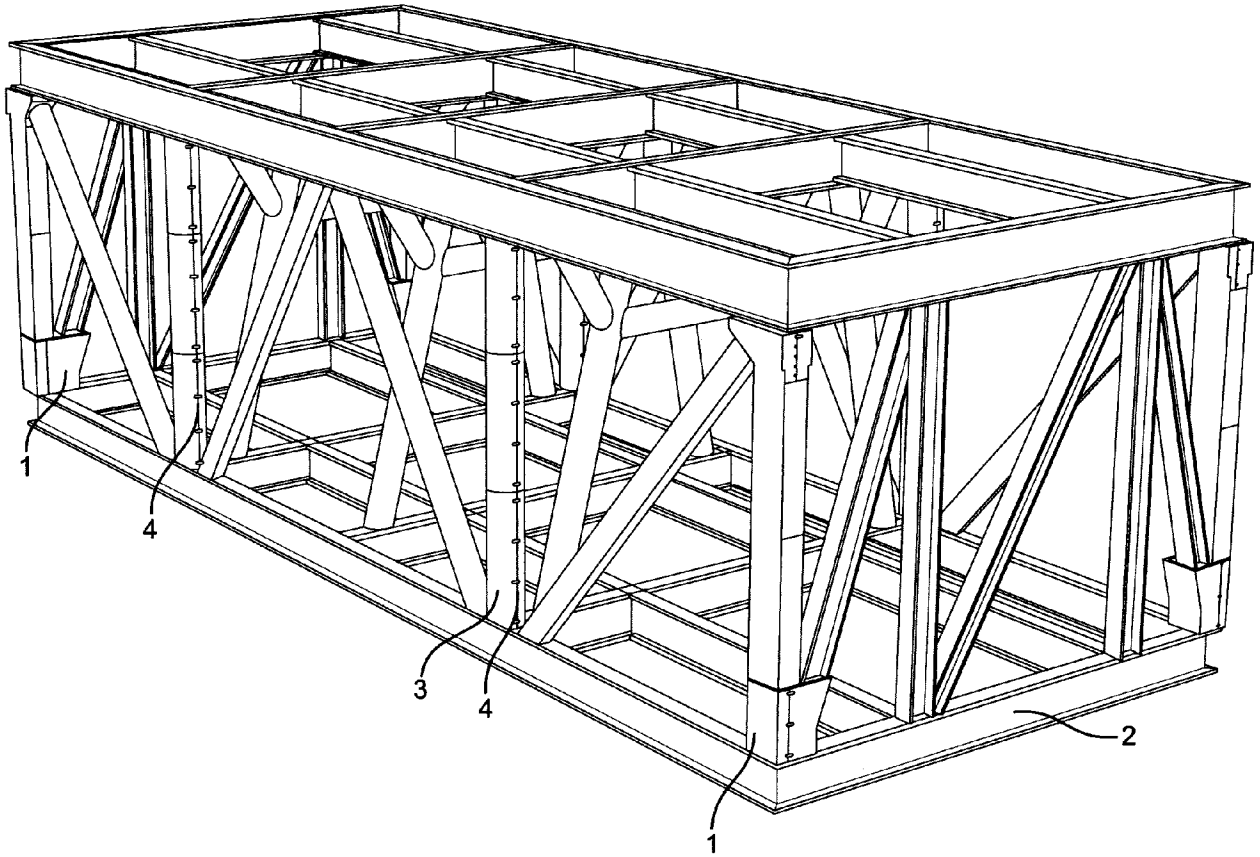
FIG. 1 is a perspective view of a fire protected steel structure with some fire protection panels according to the invention.

FIG. 1 shows a typical carrying structure such as an offshore structure 2 assembled of a combination of beams, girders and tubular support elements that in some places are protected with protection panels according to the invention. The offshore structure is made of steel, and the fire protection panels are designed to address fire protecting issues, corrosion issues and inspection issues. Curved fire protection panels 3 are shown attached around two of the tubular supports, and channel shaped fire protection panels 1 are shown attached to some of the columns. The fire protection panels 1, 3 are attached to each other in fire protection panel joints 4. Each panel should typically not exceed a weight of 25 kg. The fire protection panels can also be custom designed for various purposes, and custom designs are seen at the top and lower end of the columns.

Figure 2:
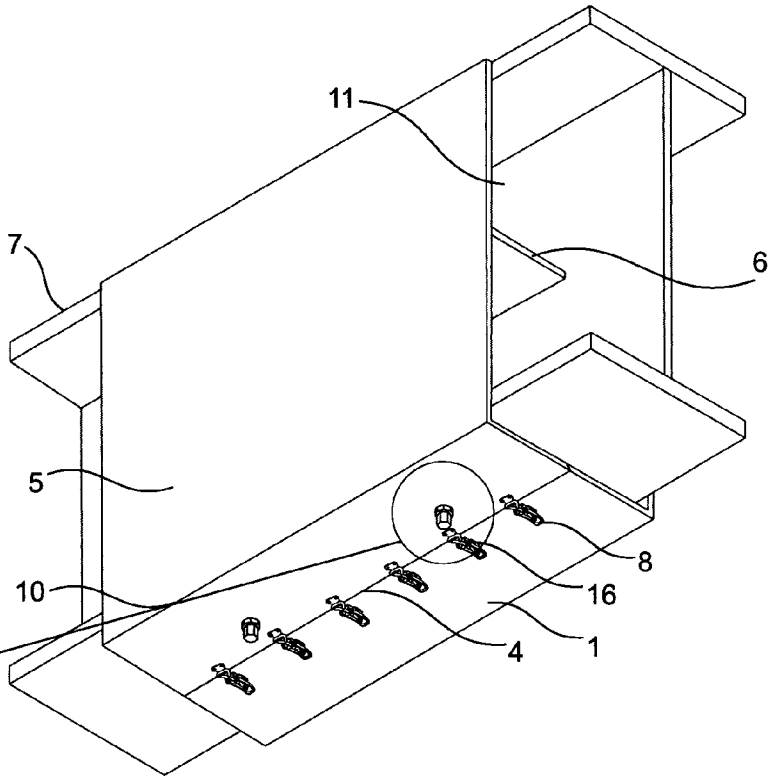
FIG. 2 is a perspective view of girder fire protection panels according to the invention.

FIG. 2 shows a detail in perspective view of L-shaped, expanding, fire protection panels 1 that are joined in a fire protection panel joint 4 with locks 8. The locks 8 are typical clamping elements of the type over-center position locks, typical suitcase locks or the like. FIG. 2 furthermore shows a steel girder 7 that is protected with the channel shaped fire protection panels 1 that are attached to each other with locks 8 in fire protection panel joint 4. The channel shaped fire protection panels 1 include explosion reinforcements 6 supporting a flat panel portion 5 towards the center section of the girder 7. A ventilation channel 11 is formed between the fire protection panel and the girder 7. Proper ventilation is essential to prevent condensation or any other build up of humidity between the fire protection panels and the structure. Drainage holes are also included, and in the shown embodiments, a drainage passage is shown in an attachment bushing 16 attached to the panel with a bushing nut 17.

Figure 3:
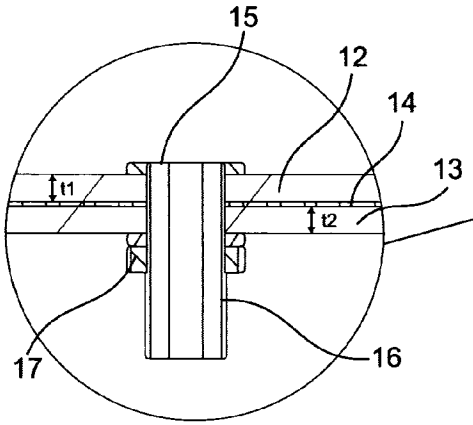
FIG. 3 is a cross section of a detail of FIG. 2, showing a bushing.

The bushing nut 17 and the attachment bushing 16 are shown in detail on FIG. 3. The attachment bushing 16 includes an attachment or drainage opening 15. The attachment bushing 16 may be covered on the inside with a fire protecting expanding layer that will seal the opening upon fire. The detail on FIG. 3 furthermore shows an inner expanding epoxy layer 12, an outer expanding epoxy layer 13, and a perforated metal plate 14 inside the epoxy layers. In FIG. 3, t1 represents a thickness of an inner epoxy layer, and t2 the thickness of an outer epoxy layer.

Figure 4:
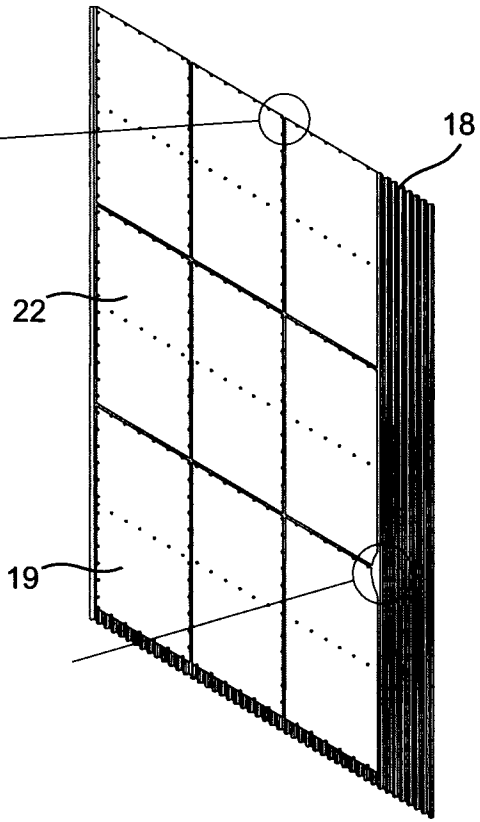
FIG. 4 is a perspective view of a corrugated panel with fire protecting panels according to the invention.

FIG. 4 shows flat fire protection panels 19 attached to corrugated panels 18 with releasable mechanical fasteners 22. Nine panels are shown, but clearly any number can be used to provide the necessary protection. The panels are shown as rectangular elements, but the shape can be adapted to the underlying structure. It should however be possible for one person to handle each panel for ease of assembly and removal, so the weight is normally limited to 25 kg.

Figure 5:
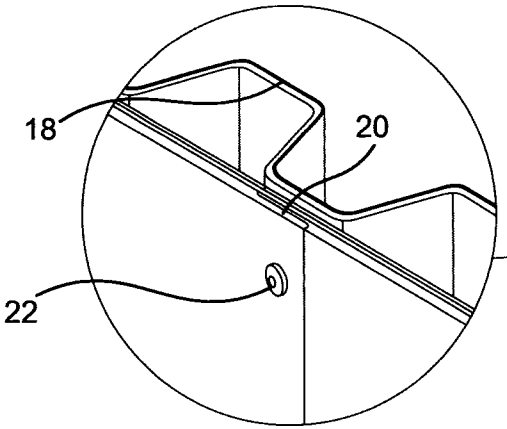
FIG. 5 is a perspective view of a detail of FIG. 4, showing a joint and a releasable fastener.

FIG. 5 shows a detail of FIG. 4, showing both a panel joint, and how channels are formed between the fire protection panel and the corrugated panel 18. As previously explained, it is important to maintain a distance between the fire protection panels and the underlying structure. FIG. 5 also shows an overlapping side joint 20 and a releasable mechanical fastener 22. The overlapping side joint 20 allows the mechanical fastener 22 to attach two adjoining panels. As can be seen in FIG. 5, it is difficult to maintain an equal distance between the panel and the underlying structure. However spacers may be used, and in the event of a fire, the heat in the structure will seek to propagate to colder areas, thus cooling the areas closer to the panel. In such conditions, the outer expanding layer may be thicker than the inner expanding layer, thus maintaining a sufficiently thick, expanded layer.

The overlapping portions may be shaped with grooves and recesses to ease assembly and to improve stability between adjoining panels.

FIG. 6 shows how panels such as flat fire protection panels 19 can be attached to a structure on top of hat shaped spacer channels 33 with releasable mechanical fasteners 22. The detail on FIG. 6 shows how the panels can be adapted to various shapes for different solutions without compromising fire protecting properties. This is further shown in FIG. 8, showing how flat fire protection panels can be attached on top of a spacer grid 32 made of hat shaped spacer channels 33 to ensure proper distance between the structure to be protected and the fire protection panels, both to allow proper ventilation between the structure and the panels, and to allow expansion of the epoxy layers toward the structure in the event of a fire. Typical panel joints with releasable mechanical fasteners 22 are shown in FIGS. 7 and 9. Releasable mechanical fasteners in this context can be bolt and nut solutions, screws, pop rivets, expanding plugs etc.

Figures 10, 11, 12:
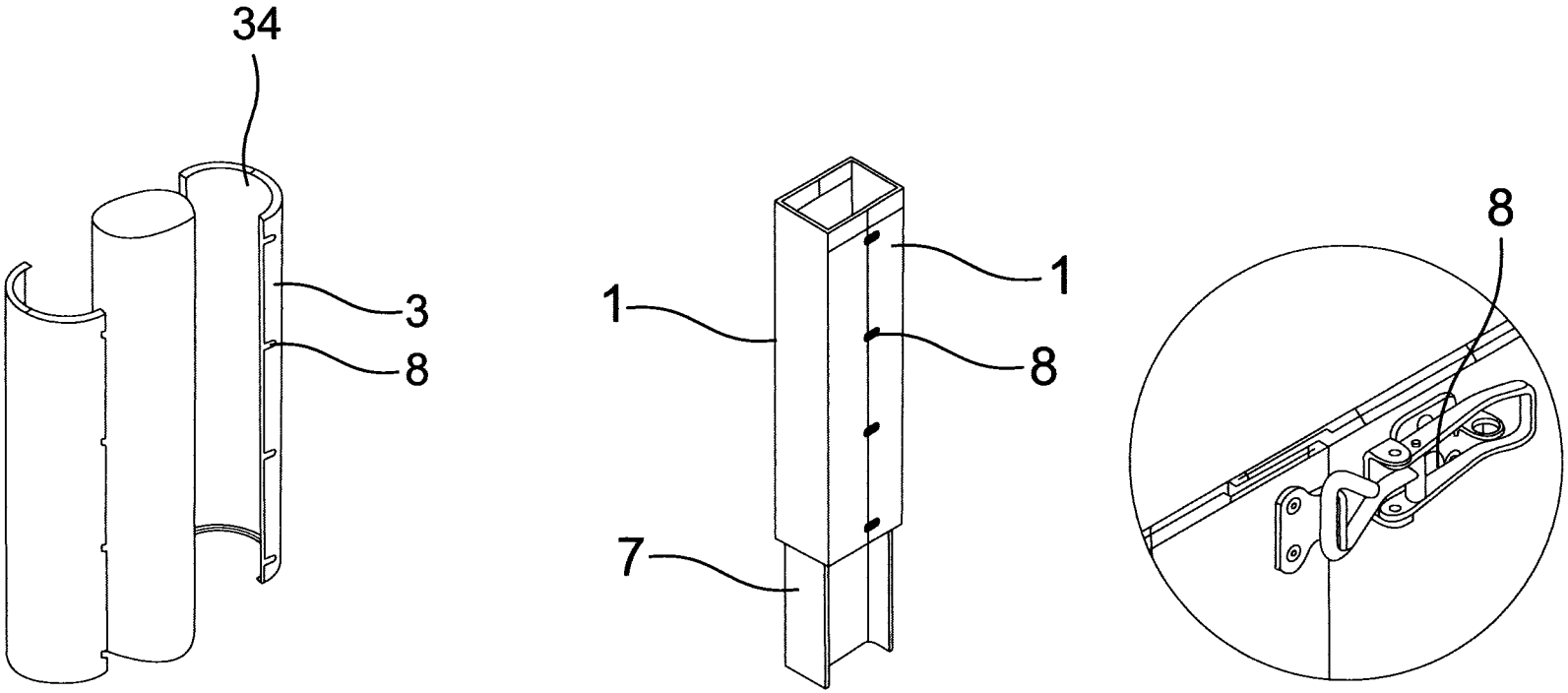
FIG. 10 is a perspective view of a cylindrical or tubular portion and suitable fire protection panels.
FIG. 11 is a perspective view of an H-shaped column covered with two U-shaped fire protection panels.
FIG. 12 is a perspective view of a detail of a typical over a center lock used in connection with the invention.

FIG. 10 shows how two curved fire protection panels 3 can be assembled around a tubular object and attached to each other with locks 8. A spacer edge portion 34 ensures a suitable distance between the curved fire protection panel 3 and the tubular object to be protected.

In FIG. 11, two channel shaped fire protection panels are enclosing a girder 7, and are attached to each other with an "over a center position lock" shown in detail in FIG. 12.

FIG. 12 also shows how the panels overlap. The lock is typically attached to the panels with pop-rivets.

Figure 13:
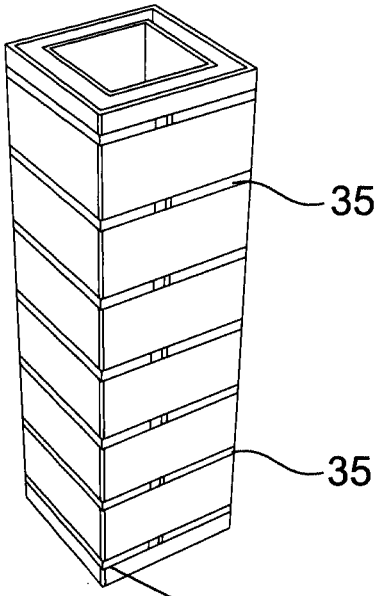
FIG. 13 is a perspective view of a rectangular channel section covered with two L-shaped fire protection panels.

FIG. 13 shows a different attachment method, where two L-shaped fire protection panels are attached to each other with attachment bands 35 around a channel section. A distance between the channel section and the L-shaped fire protection panels is maintained with spacers (not shown). The joint between the two L-shaped fire protection panels is shown in detail on FIG. 14.

Figure 14:
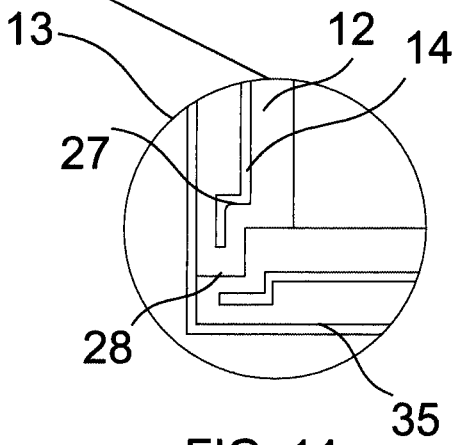
FIG. 14 is a cross section of a corner of FIG. 13.

FIG. 14 shows thus an outer expanding epoxy layer 13, a perforated metal plate 14, and an inner expanding epoxy layer 12. A stepped edge is formed along each of the L-shaped panels to form a suitable joint. Furthermore, FIG. 14 shows that the perforated metal plate 14 is bent with a Z-bend 27 along the edges to form the stepped edge 28.

Figure 15:
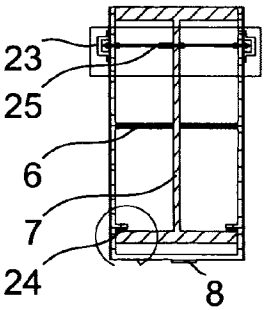
FIG. 15 is a cross section of an H-shaped girder with suitable L-shaped panels according to the invention.

FIG. 15 shows a detail in cross section of a girder 7 covered with two L-shaped fire protection panels including explosion reinforcements 6. The fire protection panels are attached to the girder 7 with attachment bars 25. An inner portion of the panels is supported against a lower flange of the girder, and the support includes a galvanic corrosion insulating material 24 between the support and the girder to prevent galvanic corrosion. At the lower end of the protection panels, the protection panels are joined with locks 8. Heat insulating fastener covers 23 protect the mechanical fasteners attached to the attachment bar 25, and also prevent the attachment bar 25 from leading heat towards the girder 7.

Figure 16:
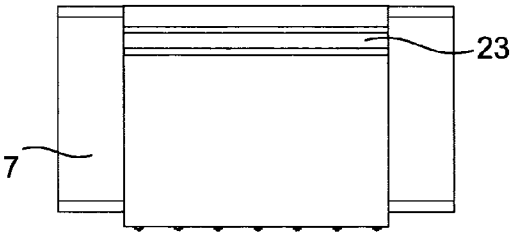
FIG. 16 is a side elevation of the girder and panels shown in FIG. 15.

FIG. 16 corresponds to a view perpendicular to the cross section of FIG. 15, showing the girder 7, the panels and the insulating fastener cover 23. In FIG. 16, the insulating fastener cover 23 is shown as a hat shaped channel. Each cover 23 includes an inner protruding portion where the galvanic corrosion insulating material 24 is attached for preventing the covers from moving in a downward direction.

Figure 17:
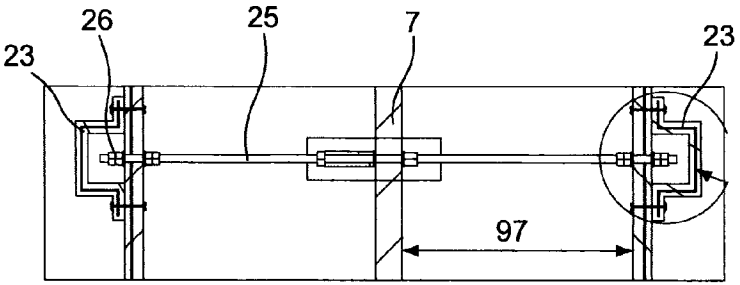
FIG. 17 is a cross section of a detail of FIG. 15, showing attachments and attachment covers.

FIG. 17 shows a detail of FIG. 15, and highlights how the attachment bar 25 attaches each panel to the girder 7 with attachments nuts 26. Furthermore, FIG. 17 shows how the insulating fastener cover 23 insulates the attachment nut 26 and the attachment bar 25 in the event of a fire. The insulating fastener cover has a hat shape and includes inner and outer epoxy layers and a perforated metal plate similarly to the other protecting panels. The covers 23 ensure that the attachment bar and the attachment nuts maintain their integrity in the event of a fire, and also reduce the transfer of heat through the attachment bar 25 to the girder 7. A distance g1 is shown between the panel and the girder.

Figure 18:
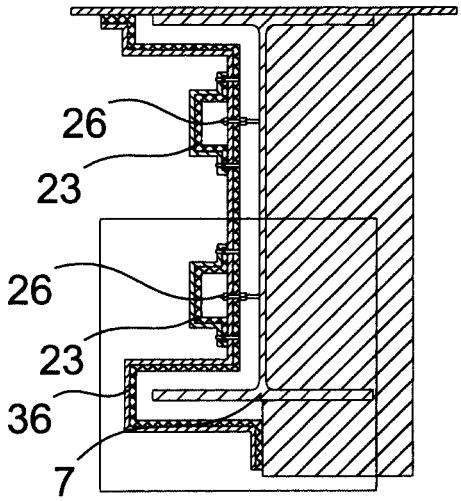
FIG. 18 is a cross section of an alternative fire protection panel for a partly embedded H-shaped girder.

FIG. 18 shows a custom protection panel 36 that is particularly adapted for a girder 7 that is partly embedded in a structure. FIG. 18 also shows how attachment nuts 26 are protected with insulating fastener covers 23, and how a gap between the custom protection panel 36 and the girder 7 is maintained. The insulating fastener covers 23 can be attached to the custom protection panel 36 with pop-rivets, or in any other suitable way allowing removal of the insolating fastener covers for access to the attachments nuts 26 for easier removal of the protection panel 36 for inspection etc. The insulating fastener covers 23 can be channel shaped, covering several attachment nuts, or can be made as individual covers, covering individual attachments.

Figure 19:
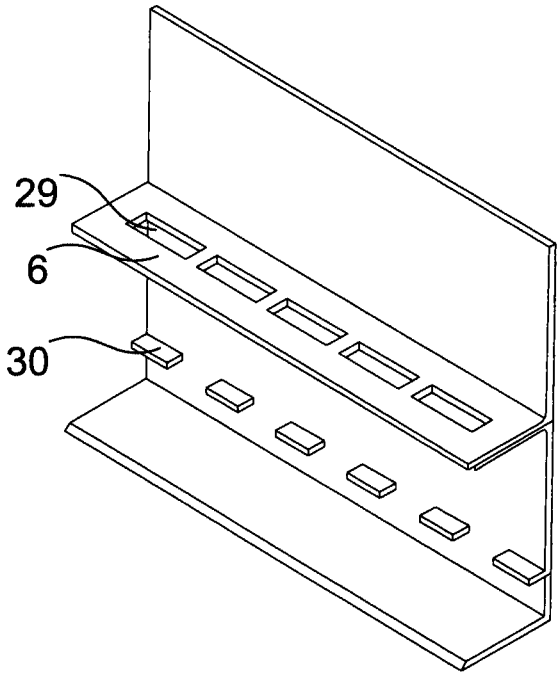
FIG. 19 is a perspective view of a L-shaped fire protection panel, also showing support and reinforcement elements.

FIG. 19 shows a substantially L-shaped fire protection panel that typically also is shown on FIGS. 15 and 16 where the explosion reinforcement 6 also includes openings 29 to reduce weight, and to ensure proper ventilation and drainage. As previously mentioned, it is very important that no humidity builds up between the fire protection panels and the underlying structure the panels are intended to protect.

Support elements 30, supports the panel, and are intended to bear against the lower flange of a girder. This is shown in FIG. 15, also showing a galvanic corrosion insulating material 24 between the girder and the supports 30.

Figure 20:
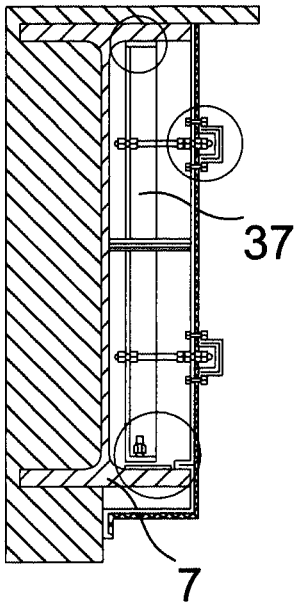
FIG. 20 is a cross section of yet another fire protection panel, attached to an H-shaped girder with an attachment element.
Figure 21:
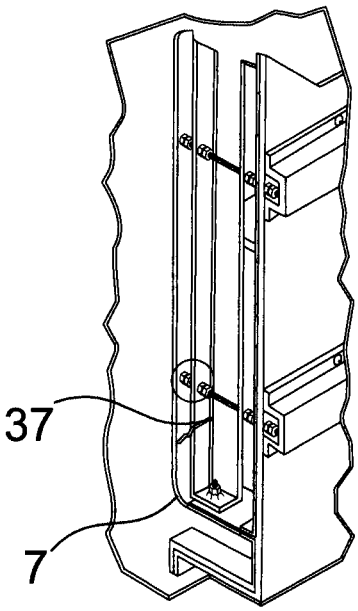
FIG. 21 is a perspective view of the solution shown in FIG. 20.
Figure 22:
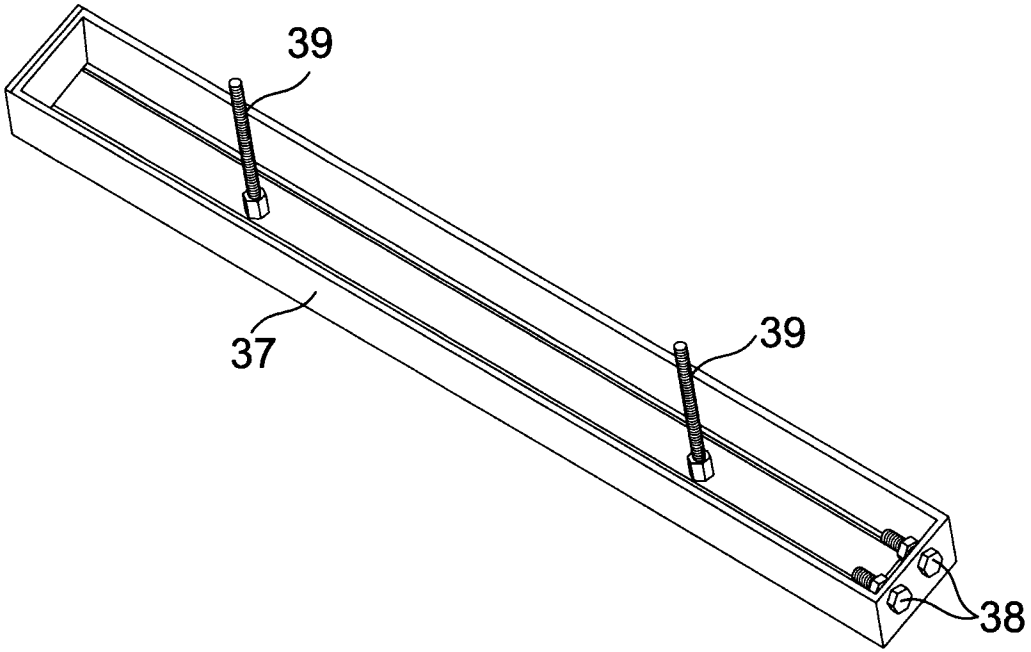
FIG. 22 is a perspective view of the attachment element.

FIGS. 20 and 21 show an alternative attachment element in cross section and perspective view respectively. A dedicated attachment element 37 is particularly useful in an environment where explosion issues are present. The attachment element 37 can be attached to the girder 7 without any substantial risk of creating sparks that typically are caused by drilling and welding.

FIGS. 20 and 21 show L-shaped protection panels attached with attachment bolts to the attachment element 37.

FIG. 23 is a detail in perspective view of the attachment element 37. The attachment element 37 can be clamped between the flanges of a girder with tensioning bolts 38 allowing the attachment element 37 to be clamped between the flanges. Panel attachment bolts 39 are secured to the attachment element 37 for attachment of fire protection panels.

The invention claimed is:

1. A jet fire and hydrocarbon fire protected structure configured to withstand explosion loads, comprising:

a steel structure with a least one flange; and at least one fire protection panel covering the steel structure, the panel including:

a perforated metal plate between an inner expanding fire protecting layer with a thickness on a first side of the perforated metal plate and an outer expanding fire protecting layer with a thickness on a second side of the perforated metal plate, the inner and outer expanding fire protecting layers extending through said perforated metal plate so as to form a connection between the inner and outer expanding fire protecting layers;

releasable mechanical fasteners for removable attachment of the at least one fire protection panel to the steel structure;

an explosion reinforcement element for providing a support between the panel and the structure in the event of an explosion; the explosion reinforcement element being plate-shaped with two flat surfaces having longitudinal and lateral edges and extending between a flat panel portion of the fire protection panel and the steel structure such that the flat surfaces are parallel to the at least one flange of the steel structure to provide support in the event of an explosion, wherein the explosion reinforcement element, flat panel portion of the fire protection panel and the steel structure form a ventilation channel, wherein the outer expanding fire protecting layer and the inner expanding fire protecting layer are epoxy layers, and wherein a gap with a gap clearance is formed between the steel structure and the fire protection panel for allowing expansion of the inner expanding fire protecting layer on the first side of the perforated metal plate.

2. The fire protected steel structure of claim 1, wherein the releasable mechanical fasteners include an attachment nut and a threaded attachment bar secured to the steel structure.

3. The fire protected steel structure of claim 2, wherein the releasable mechanical fasteners are covered with a heat insulating fastener cover on an outside of the panel, opposite the steel structure.

4. The fire protected steel structure of claim 1, wherein the releasable mechanical fasteners include over-a-center position clamping elements.

5. The fire protected steel structure of claim 1, wherein the gap clearance is greater than five times the thickness of the inner expanding fire protecting layer.

6. The fire protected steel structure of claim 1, further including an attachment element with tensioning units for providing a holding force between the attachment element and the steel structure, wherein the releasable mechanical fasteners are attached to the attachment element.

7. The fire protected steel structure of claim 1, wherein the at least one fire protection panel further includes drainage holes for preventing accumulation of liquid inside said at least one fire protection panel.

8. The fire protected steel structure of claim 7, wherein the drainage holes are formed in an open attachment bushing extending through the panel, the bushing including an inner layer of expanding fire protecting material, which seals said open attachment bushing in the event of a fire.

9. The fire protected steel structure of claim 1, wherein the explosion reinforcement element is integrally connected to the at least one panel.

10. A panel for hydrocarbon and jet fire protection of a steel structure for withstanding explosion loads, the panel comprising:

a perforated metal plate embedded between an inner expanding fire protecting layer with a thickness t1 on an inside of the perforated metal plate and an outer expanding fire protecting layer with a thickness t2 on an outside of the perforated metal plate, the inner and outer expanding fire protecting layers extending through the perforated metal plate, thereby, forming a connection between the inner and outer layers, wherein the outer expanding fire protecting layer and the inner expanding fire protecting layer are epoxy layers; and an explosion reinforcement element for providing a support between the panel and the steel structure in the event of an explosion, wherein the explosion reinforcement element is plate-shaped with two flat surfaces having longitudinal and lateral edges such that the flat surfaces are oriented parallel to an end flange of the steel structure, wherein the explosion reinforcement element is integrally connected to a first side of the panel so that the explosion reinforcement element can extend between the first side of the panel and the steel structure to provide support in the event of an explosion.

11. The panel according to claim 10, wherein the total thickness of the panel including the perforated metal plate, the inner expanding fire protecting layer with a thickness t1 on the inside of the perforated metal plate and the outer expanding fire protecting layer with a thickness t2 on the outside of the perforated metal plate is in a range from 6 mm to 22 mm.

* * * * *